United States Patent [19]

Wood

[11] 4,146,129

[45] Mar. 27, 1979

[54] ARTICLE CARRIER AND BLANK THEREFOR

[75] Inventor: Prentice J. Wood, Hapeville, Ga.

[73] Assignee: The Mead Corporation, Dayton, Ohio

[21] Appl. No.: 835,488

[22] Filed: Sep. 22, 1977

[51] Int. Cl.[2] ..... B65D 75/02

[52] U.S. Cl. ..... 206/193; 206/198; 229/28 BC

[58] Field of Search ..... 206/193, 198, 185–190, 206/162–184; 229/28 BC, 52 BC

[56] References Cited

U.S. PATENT DOCUMENTS

| | | | |
|---|---|---|---|
| 2,702,144 | 2/1955 | Forrer | 206/188 |
| 3,198,381 | 8/1965 | Gioia | 206/190 |
| 3,208,633 | 9/1965 | Graser | 206/184 |
| 3,567,069 | 3/1971 | Harrelson | 206/188 |

FOREIGN PATENT DOCUMENTS

| | | | |
|---|---|---|---|
| 1406785 | 9/1975 | United Kingdom | 206/187 |

*Primary Examiner*—Stephen P. Garbe

*Attorney, Agent, or Firm*—Walter M. Rodgers; Walter A. Rodgers

[57] ABSTRACT

An article carrier formed from a unitary blank and comprising a bottom wall, side walls secured respectively to the side edges of the bottom wall, end wall panels foldably joined respectively to the end edges of the side walls, medial panels foldably joined respectively to the edges of the end wall panels remote from the side walls and extending medially inward of the carrier, a pair of transverse partitions struck from one of the medial panels and foldably joined thereto, a longitudinal partition struck from the one medial panel and foldably joined to the pair of transverse partitions, a pair of longitudinal partitions struck from one end wall panel and foldably joined thereto, and a transverse partition struck from one of the other medial panels and from the one end wall panel and foldably joined to the pair of longitudinal panels and to the other medial panel.

22 Claims, 7 Drawing Figures

ARTICLE CARRIER AND BLANK THEREFOR

The current trend is toward the packaging of larger and larger numbers of primary packages in basket style article carriers. Carriers are known in which at least two rows of articles are accommodated on each side of the handle. These carriers are generally of the so-called strap style variety and do not provide adequate article protection as required by current railroad regulations. In addition to packaging a large number of primary packages in a single article carrier, it is most desirable to provide the greatest possible amount of material between adjacent articles.

According to this invention an article carrier is provided from a unitary blank of sheet material and comprises a bottom wall, side walls secured respectively to the side edges of the bottom wall, end wall panels foldably joined respectively to the end edges of the side walls and extending inwardly therefrom, medial partition structure foldably joined to the edges of the end wall panels remote from the side walls and extending medially inward of the carrier, the medial partition structure comprising a pair of medial panels, a pair of transverse partitions struck from one of the medial panels and foldably joined thereto, a longitudinal partition struck from the one medial panel and foldably joined to the pair of transverse partitions, a pair of longitudinal partitions struck from one end wall panel and foldably joined thereto, and a transverse partition struck from the other medial panel and from the one end wall panel and foldably joined to the pair of longitudinal partitions and to the other medial panel.

For a better understanding of the invention, reference may be had to the following detailed description taken in conjunction with the accompanying drawings in which FIG. 1 is an isometric view of an erected carrier formed according to this invention;

FIGS. 3, 4 and 5 represent intermediate steps through which the blank is manipulated in order to form the complete and collapsed carrier shown in FIG. 6; and in which

Figure 1:
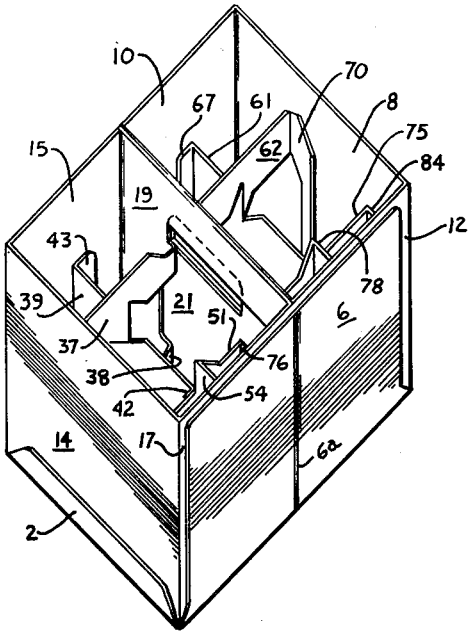
Figure 2:
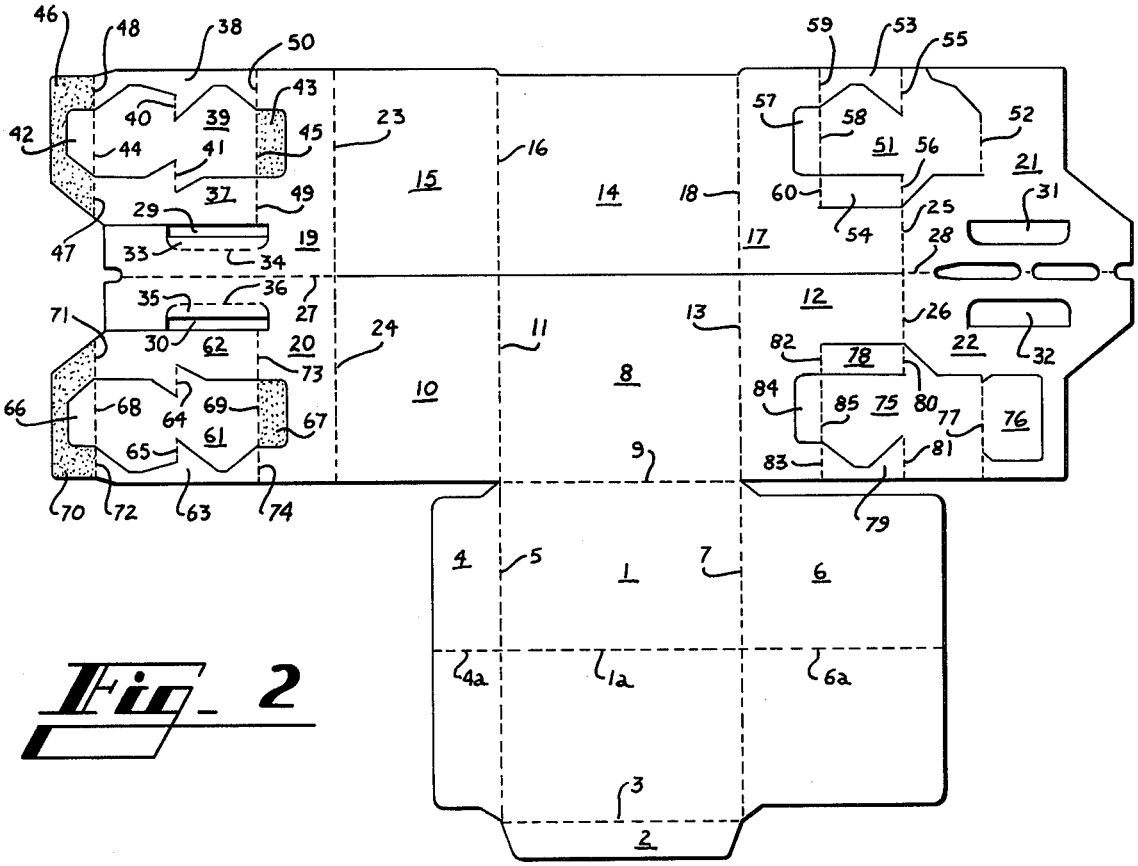
FIG. 2 is a plan view of a unitary blank from which the carrier shown in FIG. 1 is formed.

In the drawings and with particular reference to FIG. 2, the numeral 1 designates the bottom wall of the carrier to a side edge of which glue flap 2 is foldably joined along fold line 3. In addition auxiliary glue flap 4 is foldably joined to bottom wall 1 along fold line 5 and auxiliary panel 6 is foldably joined to bottom wall 1 along fold line 7. Bottom wall 1, auxiliary glue flap 4 and auxiliary panel 6 are all provided with medial fold lines 1*a*, 4*a*, and 6*a* respectively.

Side wall 8 is foldably joined to bottom wall 1 along fold line 9. To one end edge of side wall 8, end wall panel 10 is foldably joined along fold line 11. Likewise end wall panel 12 is foldably joined to the opposite end edge of side wall 8 along fold line 13.

The opposite side of the blank is similarly constructed and includes side wall 14 to an end edge of which end wall panel 15 is foldably joined along fold line 16. Similarly end wall panel 17 is foldably joined to side wall 14 along fold line 18.

Medial partition structure for the carrier is provided and includes medial panels 19, 20, 21 and 22. Medial panels 19 and 20 are foldably joined respectively to end wall panels 15 and 10 along fold lines 23 and 24. In similar manner medial panels 21 and 22 are foldably joined respectively to end wall panels 17 and 12 along fold lines 25 and 26. Also medial panels 19 and 20 are foldably joined together along fold line 27 and similarly medial panels 21 and 22 are foldably joined together along interrupted fold line 28.

In order to facilitate transport of the carrier, hand gripping apertures 29, 30, 31 and 32 are formed in medial panels 19, 20, 21 and 22 respectively. In addition hand gripping aperture 29 is provided with hand cushioning flap 33 which is foldably joined to medial panel 19 along fold line 34. Likewise, hand gripping aperture 30 is provided with hand cushioning flap 35 which is foldably joined to medial panel 20 along fold line 36.

For the purpose of providing maximum article protection, partition means is provided for the interior of the carrier. More specifically transverse partitions 37 and 38 are foldably joined to longitudinal partition 39 along fold lines 40 and 41. Also longitudinal partition 39 is provided with anchoring tabs 42 and 43 which are foldably joined to longitudinal partition 39 along fold lines 44 and 45 respectively. Anchoring flap 46 is foldably joined to transverse partitions 37 and 38 along fold lines 47 and 48 and transverse partitions 37 and 38 are foldably joined to medial panel 19 along fold lines 49 and 50 respectively.

At the other end of the blank, partition means is provided in the form of transverse partition 51 which is foldably joined to medial panel 21 along fold line 52. In addition longitudinal partitions 53 and 54 are foldably joined to transverse partition 51 along fold lines 55 and 56 respectively. Anchoring tab 57 is foldably joined to transverse partition 51 along fold line 58. Also longitudinal partitions 53 and 54 are foldably joined to end wall panel 17 along fold lines 59 and 60.

Partition means on the other side of the carrier are similar to that just described and include longitudinal partition 61 which is foldably joined to transverse partitions 62 and 63 along fold lines 64 and 65 respectively. Longitudinal partition 61 is provided with anchoring tabs 66 and 67 which are foldably joined to longitudinal partition 61 along fold lines 68 and 69 respectively. Anchoring flap 70 is foldably joined to transverse partitions 62 and 63 respectively along fold lines 71 and 72. Also transverse partitions 62 and 63 are foldably joined respectively to medial panel 20 along fold lines 73 and 74.

At the other end of the carrier transverse partition 75 is provided and is foldably joined to medial partition tab 76 along fold line 77. Longitudinal partitions 78 and 79 are foldably joined to transverse partition 75 respectively along fold lines 80 and 81. Longitudinal partitions 78 and 79 are foldably joined at their other ends to end wall panel 12 along fold lines 82 and 83 respectively. Transverse partition 75 is provided with anchoring flap 84 which is foldably joined thereto along fold line 85.

In order to form the completed carrier from the unitary blank shown in FIG. 2, an application of glue is first made to anchoring tabs 43 and 67 as shown by stippling in FIG. 2. In addition glue is applied to anchoring flaps 46 and 70 as shown by stippling in FIG. 2. Thereafter medial panels 19 and 20 together with their associated partition means are elevated and folded toward the right along fold lines 23 and 24 to occupy the positions shown in FIG. 3. By this operation anchoring tabs 43 and 67 become adhered to end wall panels 15 and 10 respectively and, likewise, anchoring flaps 46 and 70 are adhered respectively to side walls 14 and 8.

Figure 3:
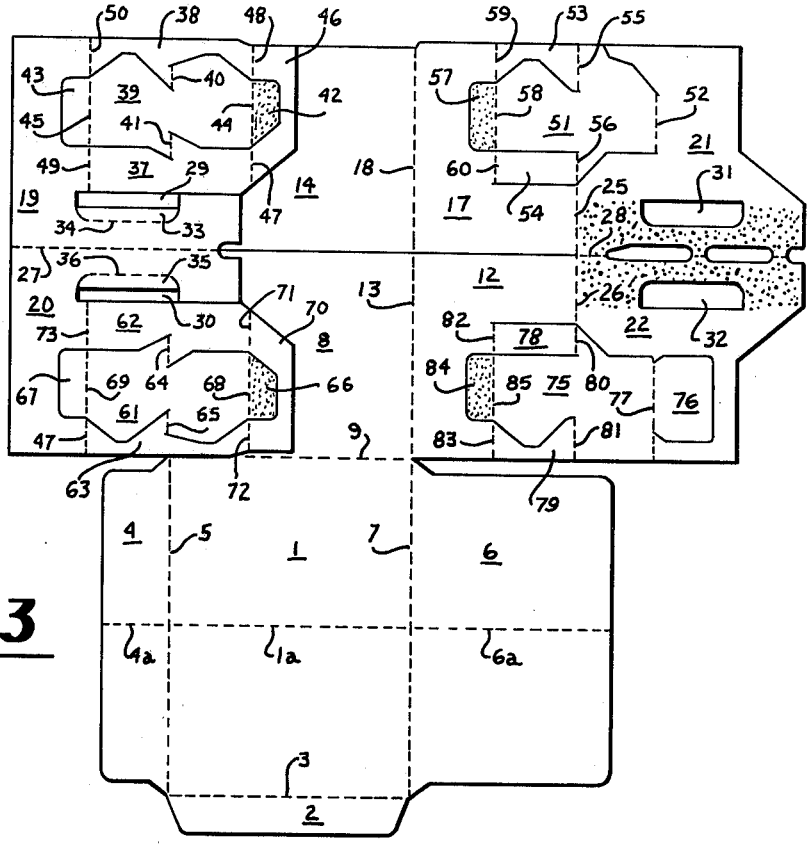

Following this operation, an application of glue is made to anchoring tabs 42 and 66 as indicated by stippling in FIG. 3. Also as indicated by stippling in FIG. 3, glue is applied to anchoring tabs 57 and 84 and to the handle area of medial panels 21 and 22. Medial partition tab 76 is then folded downwardly, as viewed in FIG. 3, along fold line 77. Following this, end wall panels 17 and 12 and medial panels 21 and 22 together with the associated partition means are all elevated and folded toward the left along fold lines 18 and 13. After this operation, anchoring tabs 57 and 84 are adhered to side walls 14 and 8 respectively. In addition anchoring tabs 42 and 66 are adhered to transverse partitions 51 and 75 respectively. The carrier elements then appear as shown in FIG. 4.

Figure 4:
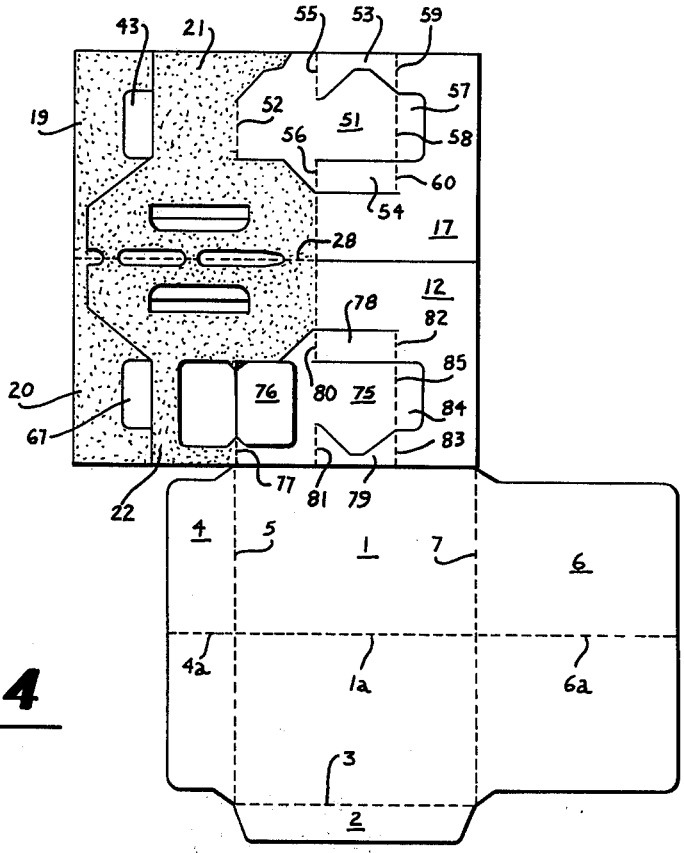
Figure 5:
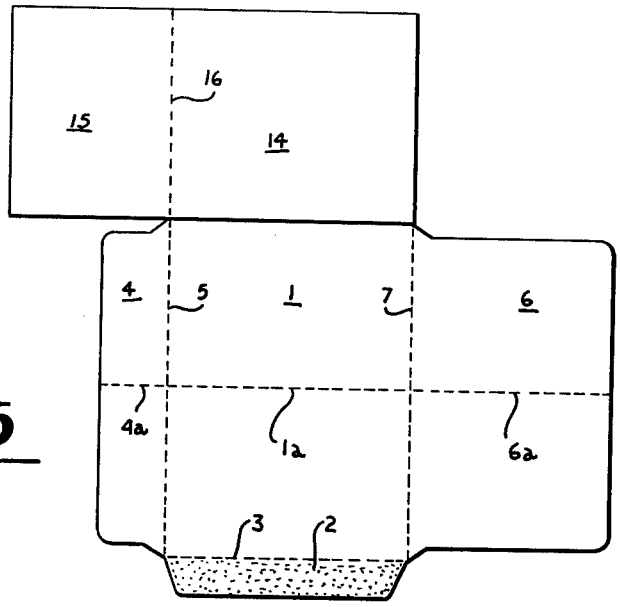

Then, an application of glue is made to the exposed portions of medial panels 19 and 20 as well as to medial panels 21 and 22 as indicated by stippling in FIG. 4. Thereafter the portion of the blank above fold lines 27 and 28 is elevated and folded over to occupy the position shown in FIG. 5. Then an application of glue is made to glue flap 2 as indicated by stippling in FIG. 5. The carrier is then folded along medial fold lines 1*a*, 4*a*, and 6*a* to occupy the position shown in FIG. 6 to cause glue flap 2 to adhered to the lower portion of side wall 14 which position represents the completed carrier in collapsed condition.

Figure 6:
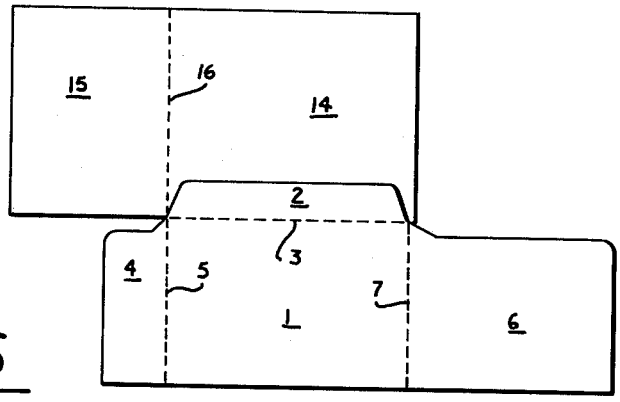
Figure 7:
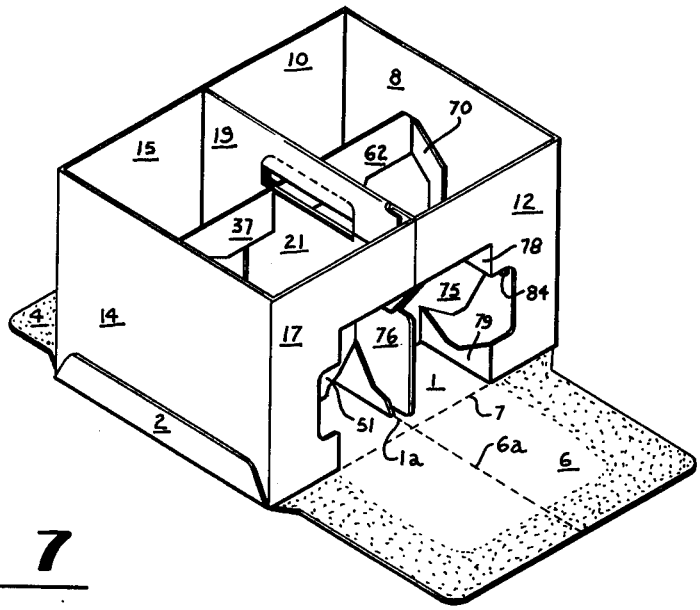
FIG. 7 is an isometric view of a partially formed carrier.

In order to set up the carrier from the collapsed condition shown in FIG. 6, it is simply necessary to prevent movement of the carrier toward the left and to apply pressure to the medial edges of end wall panels 12 and 17. By this operation the side walls are moved into a position perpendicular to the end wall panels and simultaneously the bottom wall is folded into a flat plane. The carrier then appears as shown in FIG. 7. Following this, glue is applied to auxiliary glue flap 4 as well as to auxiliary panel 6 as shown by stippling in FIG. 7 and both elements are then folded upwardly along fold lines 5 and 7 respectively. By this operation and according to a feature of this invention, the portions of end wall panels 12 and 17 from which part of the partition means is struck are covered in the completed carrier by auxiliary panel 6.

Therefore by this invention an article carrier is provided which accomodates a large number of primary packages and at the same time provides a maximum amount of article separation with a minimum of material.

The embodiments of the invention in which an exclusive property or privilege is claimed are defined as follows:

I claim:

1. An article carrier comprising a bottom wall, side walls secured respectively to the side edges of said bottom wall, end wall panels foldably joined respectively to the end edges of said side walls and extending inwardly therefrom, medial partition structure foldably joined to the edges of said end wall panels remote from said side walls and extending medially inward of the carrier, said medial partition structure comprising a pair of medial panels, a pair of transverse partitions struck from one of said medial panels and foldably joined thereto, a longitudinal partition struck from said one medial panel and foldably joined to said pair of transverse partitions, a pair of longitudinal partitions struck from one of said end wall panels and foldably joined thereto, and a transverse partition struck from the other of said medial panels and from said one end wall panel and foldably joined to said pair of longitudinal partitions and to said other medial panel.

2. An article carrier according to claim 1 wherein said transverse partition struck from the other of said medial panels is disposed perpendicular to said longitudinal partition struck from said one medial panel and secured to one end thereof.

3. An article carrier according to claim 1 wherein a medial partition tab is joined to said other medial panel along a fold line which is in alignment with the fold line between said transverse partition and said other medial panel.

4. An article carrier according to claim 1 wherein an auxiliary panel is foldably joined to an end edge of said bottom wall and adapted to cover the portion of said one end wall panel from which said transverse partition and said pair of longitudinal partitions are struck.

5. An article carrier comprising a bottom wall, side walls secured respectively to the side edges of said bottom wall, end wall panels foldably joined respectively to the end edges of said side walls and extending inwardly therefrom, medial partition structure foldably joined to the edges of said end wall panels remote from said side walls and extending medially inward of the carrier, said medial partition structure including a pair of face contacting medial panels, first partition means struck from one of said medial panels and including a first transverse partition foldably joined to said one medial panel and a first longitudinal partition foldably joined to said first transverse partition, second partition means struck in part from the other of said medial panels and including a second transverse partition foldably joined to said other medial panel and a second longitudinal partition foldably joined to said second transverse partition, an auxiliary panel foldably joined to an end edge of said bottom wall and adapted to cover the portion of said adjacent end wall panel from which said second partition means is struck.

6. An article carrier according to claim 5 wherein said second partition means is struck in part from the adjacent one of said end wall panels.

7. An article carrier according to claim 5 wherein said second longitudinal partition is struck from the adjacent one of said end wall panels.

8. An article carrier according to claim 5 wherein an end of said first longitudinal partition is secured to said second transverse partition.

9. An article carrier according to claim 8 wherein said longitudinal partitions are aligned with each other.

10. An article carrier according to claim 5 wherein said first transverse partition is foldably joined to said first longitudinal partition along a vertical fold line and wherein said second transverse partition is foldably joined to said second longitudinal partition along a vertical fold line.

11. An article carrier according to claim 5 wherein said first transverse partition and said second transverse partition are each secured to the associated one of said side walls.

12. An article carrier according to claim 5 wherein a medial partition tab is foldably joined to the inner end edge of said second transverse partition and is disposed perpendicular thereto.

13. An article carrier comprising a bottom wall, side walls secured respectively to the side edges of said bottom wall, end wall panels foldably joined respectively to the end edges of said side walls and extending inwardly therefrom, medial partition structure foldably joined to the edges of said end wall panels remote from said side walls and extending medially inward of the carrier, a longitudinal partition struck from said medial partition structure and disposed in parallel spaced relation thereto, and a transverse partition struck from said medial partition structure and from one of said end wall panels and disposed perpendicular to said longitudinal partition and in abutting relation with one end thereof.

14. An article carrier according to claim 13 wherein a second transverse partition is struck from said medial partition structure and is foldably joined to said longitudinal partition along a vertical fold line.

15. An article carrier according to claim 13 wherein a second longitudinal partition is struck from said one end wall panel and is foldably joined to said transverse partition.

16. An article carrier according to claim 13 wherein said longitudinal partition is secured to said transverse partition.

17. An article carrier according to claim 15 wherein an auxiliary panel is foldably joined to an end edge of said bottom wall and adapted to cover the portion of said one end wall panel from which said transverse partition and said second longitudinal partition are struck.

18. An article carrier according to claim 13 wherein a medial partition tab is foldably joined to the inner edge of said transverse partition and is disposed perpendicular thereto.

19. An article carrier blank comprising a bottom wall, a side wall foldably joined to a side edge of said bottom wall, a pair of end wall panels foldably joined respectively to the end edges of said side wall, a pair of medial panels foldably joined respectively to the edges of said end wall panels remote from said side wall, first partition means struck from one of said medial panels and foldably joined thereto along a vertical fold line, and second partition means struck from the other of said medial panels and from the adjacent end wall panel and foldably joined thereto along a vertical fold line.

20. An article carrier blank according to claim 19 wherein said first partition means and said second partition means each comprises a longitudinal partition and a transverse partition foldably joined along a vertical fold line.

21. An article carrier blank according to claim 19 wherein an auxiliary panel is foldably joined to an end edge of said bottom wall.

22. An article carrier blank according to claim 20 wherein a medial partition tab is foldably joined to said transverse partition of said second partition means.

* * * * *